United States Patent [19]

Paulus

[11] 4,313,772

[45] Feb. 2, 1982

[54] CONTINUOUS HEAT-TREATMENT PROCESS FOR STEEL STRIP

[75] Inventor: Philippe A. Paulus, Liege, Belgium

[73] Assignee: Centre de Recherches Metallurgiques-Centrum voor Research in de Metallurgie, Brussels, Belgium

[21] Appl. No.: 908,684

[22] Filed: May 23, 1978

[30] Foreign Application Priority Data

May 24, 1977 [BE] Belgium ..... 854999

[51] Int. Cl.[3] ..... C21D 1/18; C21D 9/52

[52] U.S. Cl. ..... 148/142; 148/12 C; 148/12.3; 148/143

[58] Field of Search ..... 148/142, 143, 144, 153, 148/155, 156, 12 C, 12 D, 12.4, 28, 12.3

[56] References Cited

U.S. PATENT DOCUMENTS

| | | | |
|---|---|---|---|
| 3,669,762 | 6/1972 | Takeo et al. | 148/28 |
| 4,011,109 | 3/1977 | Golland et al. | 148/12.4 |
| 4,023,987 | 5/1977 | Nomura et al. | 148/12 D |
| 4,040,873 | 8/1977 | Nakaoka et al. | 148/12 C |
| 4,065,329 | 12/1977 | Paulus et al. | 148/143 |
| 4,087,290 | 5/1978 | Kopietz et al. | 148/28 |

*Primary Examiner*—Peter K. Skiff

*Attorney, Agent, or Firm*—Holman & Stern

[57] ABSTRACT

In a continuous heat-treatment process, cold-rolled steel strip having a thickness of 0.05 to 1 mm, e.g. for producing tin plate, is heated to 650°–850° C. and held in this temperature range for more than 1 s. The strip is then quenched for less than 12 seconds in an aqueous bath at above 75° C., the strip emerging at below 550° C. Temperatures, times, and subsequent steps such as overaging and final cooling are chosen depending on the hardness desired.

2 Claims, 6 Drawing Figures

CONTINUOUS HEAT-TREATMENT PROCESS FOR STEEL STRIP

The present invention relates to a continuous process for heat-treating strip, in particular "black strip" for use in the production of tin plate.

The main advantage presented by continuously annealed steel with respect to conventional steel annealed in a bell furnace (close annealing) is its great uniformity of its mechanical properties and its planarity. Further advantages are due to the suppression of drawbacks inherent to conventional annealed steel, e.g. risk of sticking between coiled turns, which may result in accidents during skin-pass, numerous manipulations, storage, etc.

So far as tin plate is concerned, the qualities obtained are generally expressed as classes of hardness HR30T among which the most common are the following ASTM "tempers":

T1: hardness 46 to 52
T2: hardness 50 to 56
T3: hardness 54 to 60
T4: hardness 58 to 64
T5: hardness 62 to 68 or UT (universal temper)
T6: hardness 67 to 73
(T8): hardness 75 to 83 proposed for extra-fine tin plate.

The tempers T1 (killed steel for deep drawing), T2, and T3 can generally be obtained only by close annealing, since continuous annealing results in too hard a product. The other tempers may be obtained by close annealing or by continuous annealing. The latter however, is clearly more advantageous since, owing to the greater hardness naturally imparted to the product in this fashion, it is possible to obtain great hardness in milder steel, which considerably increases the output of a tandem train of cold rolling mills. The treatment cycle mostly used at the present time is illustrated in FIG. 1. of the accompanying drawings. It usually comprises the following four steps:

I. heating to about 600° C. (for example for 16s for a strip thickness of 0.25 mm),
II. holding and homogenization at 600° to 720° C. (for example for 22s for a thickness of 0.25 mm),
III. "controlled" cooling to 425° C. (for example for 22s for a thickness of 0.25 mm).
IV. "rapid" cooling to 75° C. (for example to 22s for a thickness of 0.25 mm),
i.e. a total time of 82 seconds is required for a thickness of 0.25 mm.

The moderate cooling rate during step III is necessary for producing the lowest "tempers" (hardness). Accelerated cooling during step IV is intended to shorten the production line but is obviously limited owing to the increasing inefficiency of the cooling produced by jets of atmospheric gas at low temperatures. With the strip speeds (400 to 600 m/minute) which can be reached in practice in modern lines, durations which are apparently short still require quite long paths for the strip.

Various improvements have already been suggested to shorten the annealing cycle of tin plate strip without changing the range of qualities obtained, i.e.:

more rapid heating, for example by direct firing;

substantial shortening of the holding step, recrystallization being almost instantaneous at the high reduction rates applicable to tin plate strip;

shortening of the final cooling step by quenching in cold water starting from a temperature sufficiently low to avoid risks of deterioration of planarity. FIG. 2 shows a treatment cycle in which use is made of these various improvements. The total treatment time is thus reduced to 50 seconds (for a thickness of 0.25 mm) but the tempers T1, T2, T3 cannot generally be obtained.

FIG. 2 thus illustrates a process comprising the following four steps:

1. Heating to above 750° C. (for 3.1s for a thickness of 0.25 mm). If this heating is compared with that of FIG. 1, one sees that it brings about the improvement of being more rapid, for it is effected for example by means of direct firing. Moreover, the temperature at the end of heating is higher: 750° C. instead of 600° C.

II. Holding and homogenization at 750° to 720° C. (for 1.6s for a thickness of 0.25 mm). Compared with that of FIG. 1, this holding step is considerably shortened (from 22s to 1.6s). This improvement is possible because recrystallization is almost instantaneous for the high reduction rates applied to tin plate strip.

III. Controlled cooling to 490° C. (for 17.6s for a thickness of 0.25 mm).

IV. Rapid cooling to 250° C. by means of an atmospheric jet, then final cooling by quenching in cold water. The duration of this step is 27.6s for a thickness of 0.25 mm. Cooling by means of a jet of atmospheric gas has been shortened by quenching in cold water starting from 250° C., which is a temperature sufficiently low to avoid any risk of planarity deterioration. This shortening also results in one of the improvements suggested up to the present time, i.e. a total time of 50 seconds for a thickness of 0.25 mm.

Starting from a similar cycle (rapid heating, no holding), GARBER (ISI Special Report 79, pages 81 to 86) and WILLIAMS (ISI Special Report 79, pages 87 to 92) have proposed to further shorten the cooling step by quenching from the recrystallization temperature in a bath at about 300° C. and by coiling the strip at that stage so as to let overaging to take place in the coiled state. However, neither the quenching step nor the coiling step under atmosphere at 300° C. seem to be practicable on an industrial scale.

Other authors have studied processes capable of permitting improvement in quality (higher tempers) and shortening of the lines at the same time. However, the suggested processes seem to be of little practical use in industrial conditions. This is the case, for example, with a process comprising quenching in water starting from the recrystallization temperature (French Pat. No. 1 479 039); it seems that the difficulty of ensuring uniform cooling has been underestimated by the authors.

Many authors have suggested adapting to tin plate strip the continuous annealing cycles already applied to strip having a much higher thickness (greater than 0.6 mm) and based on the addition to the main cycle of a carbon precipitation stage.

A continuous annealing installation for strip based on water quenching but in which strip having a thickness smaller than 0.6 mm is deviated before quenching, and is thus subjected only to moderate jet cooling before carbon precipitation, is described in the U.S. Pat. No. 3,877,684. The justification of such an installation is thought to be the impossibility of ensuring good planarity of strip having a small thickness after quenching in cold water.

Another suggestion of adaptation to tin plate strip of a continuous annealing cycle for extra-mild steel is described in the published French Patent Application No. 75 39 163. In this case, however, the effect of overaging added to the main cycle is very small, for the hardness HR 30T is only lowered by two or three points during this operation, which, on the other hand, is relatively long. This process is therefore capable of producing hardness T3 only provided the composition of the strip is strictly controlled. BELLAMY and GARHER (JISI, August 1972, pages 588 to 605) have studied the properties of mild steel cooled at speeds of 300° to 6600° C./s, but the industrial use of the chosen quenching baths does not seem to be practical at all, while homogeneity problems do not seem to be adequately solved. Another author (G.K.L'VOV, Metalloved, Term.Obra.Met., 1959 4, pages 8 to 14; British Pat. No. 1,154,422) has taken advantage of a very high heating speed, heating being followed by holding for a very short time at the reached temperature and very rapid cooling, to cause steel recrystallization without allowing the grain to grow and with no carbon dissolution. However, in this case too, industrial application seems hardly practicable in the near future, given the present state of the art.

WILLIAMS and DAVIES (ISI Special Report, 79, pages 93 to 100) have tried to use the continuous annealing process developed by BISRA(GIBBONS, ISI Special Report, 79, pages 101 to 111) to perform a new annealing cycle making it possible either to achieve the temper T6 starting from milder steels, (without phosphorus), or to obtain a hardness equivalent to those of "double reduced" steel but with no re-rolling. Although it has been found that it is possible to increase the hardness by rapid cooling, the main obstacle is the provision of a safe technology for effecting rapid cooling as is shown for example by the impossibility of carrying out the BISRA process in a high-speed line.

We have already suggested, in Belgian Pat. No. 837 458, a continuous process for heat treating thin cold rolled strip, which process is also applicable to high-strength strip and to mild steel strip for drawing. It has been found that the process, when suitably adapted, makes it possible to enlarge the range of qualities of continuously annealed black strip for producing tin plate, both towards the upper and the lower limit of the temper scale.

The invention is based on the fact that, when applied to steel strip of small thickness (smaller than 0.6 mm), tempering in an aqueous bath at its boiling temperature makes it possible to obtain a very high cooling rate while ensuring perfect uniformity of properties and perfect planarity. The cooling speed is sufficient to retain almost all the interstitial elements in solution after rapid cooling. Consequently, if no subsequent operation is effected, the steel is extremely hard owing to the fact that carbon and nitrogen are locked in the ferrite lattice. These elements tend to precipitate in the form $Fe_2C$ upon melting of the tin layer (flow brightening) after electro deposition of tin, and the conventional hardening taking place at that time is substantially increased.

Finally, by heating steel above the $A_1$ point a certain amount of austenite is formed and total dissolution of the carbon contained in the steel occurs.

Owing to subsequent rapid cooling, it has been found that it is possible to further substantially increase the initial hardness of the same steel.

A second object is to provide mild tempers by continuous annealing. In this case, an overaging operation designed to cause precipitation of insterstitial elements is added to the preceding operations, i.e. heating, holding, and quenching in an aqueous bath at a temperature higher than 75° C.

As shown in the above-described example, it has been found that after such a rapid cooling, the hardness decrease during overaging is considerable and very rapid at the same time, e.g. 6 to 8 points HR30T after holding for a few seconds at a temperature of 350° to 550° C. In this case it may be also advantageous to provide a certain holding time at a temperature higher than the $A_1$ point to assist grain growth, but it is then preferable to start rapid cooling only below the point $A_1$ to allow austenite to be transformed into ferrite.

In view of the above considerations, the present invention provides a process for continuously heat-treating black strip having a thickness of 0.05 mm to 1 mm, e.g. strip intended for producing tin plate, the process comprising a heating operation followed by a rapid cooling operation, in which the heating operation comprises, on the one hand, heating the strip to a temperature of 650° to 850° C., and, on the other hand, keeping the strip for more than a second in this temperature range, and in which the cooling operation comprises at least one quenching operation for a duration shorter than 12 seconds in an aqueous bath kept at a temperature substantially higher than 75° C., preferably at its boiling point, the strip emerges from the aqueous bath at a temperature lower than 550° C.

When one wishes to give tin plate relatively low hardness (tempers 1 to 4), the said temperature range is 650° to 750° C. and the immersion time in the aqueous bath is shorter than 4.5 seconds. Advantageously, the strip emerges from the aqueous bath at a temperature in the range of 250° to 550° C., preferably 350° to 500° C., which is a temperature range suitable for overaging, and the strip is kept within this temperature range for a time longer than 4 seconds.

To prolong the time for which the strip is kept at the overaging temperature, the final cooling may be effected by quenching in an aqueous bath at a temperature higher than 75° C.

In the case in which one wishes to give tin plate strip high hardness (temper higher than 4), the immersion time in the aqueous bath is shorter than 6 seconds. The strip then advantageously emerges from the aqueous bath at a temperature of 75° to 300° C.

The immersion time in the aqueous bath may be modified by changing the water level in the vessel containing the bath.

The thickness of the strip is advantageously 0.05 mm to 0.6 mm.

The invention will be described further, by way of example only with reference to the accompanying drawings, relating to the production of strip to be tin-plated.

In the drawings:

FIG. 1 (as already mentioned above) illustrates a heat-treatment cycle commonly used at the present time. This cycle comprises a heating step (I), a holding step (II), a controlled cooling step (III), and a rapid cooling step (IV).

FIG. 2 illustrates a cycle similar to that of FIG. 1 (steps I,II,III,IV) with the addition of the various improvements suggested up to now and described above.

FIGS. 3 to 5 illustrate processes in accordance with the present invention, i.e. processes all comprising quenching in an aqueous bath kept at a temperature higher than 75° C.

Figure 1:
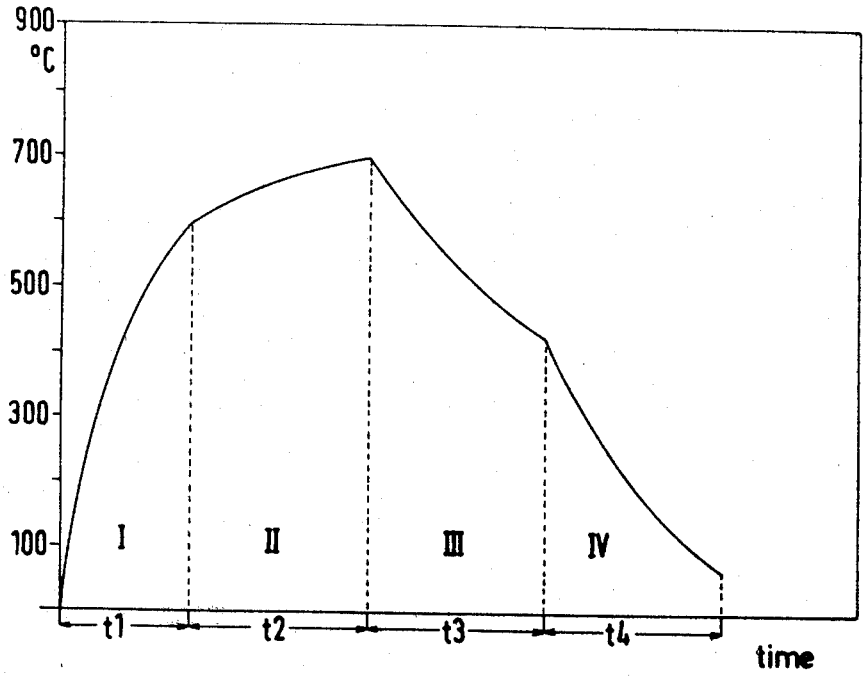
FIGS. 1 to 5 are graphs of strip temperature (°C.) versus time (seconds).
Figure 2:
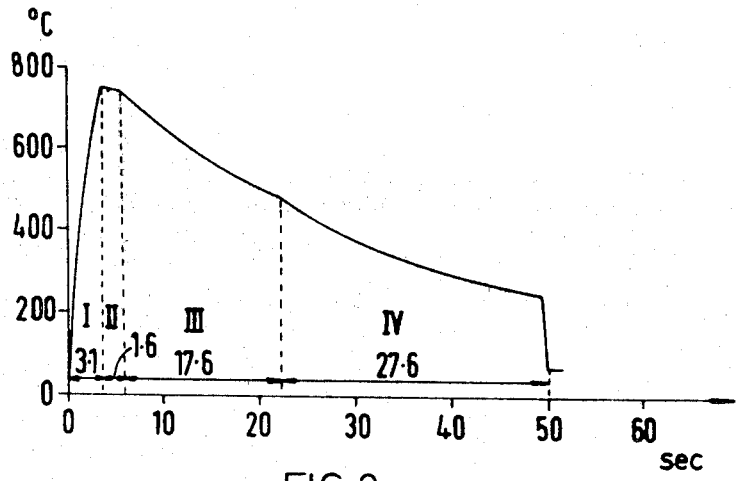

FIGS. 1 and 2 will not be described again since they have already been explained above. The cycle of FIG. 1 has a duration of 82s for a strip thickness of 0.25 mm and is generally considered as a long cycle. Compared with the cycle of FIG. 1, the cycle of FIG. 2 is considered to be a short cycle which is very advantageous in the case of new lines which may be constructed with much shorter lengths.

Figure 3A:
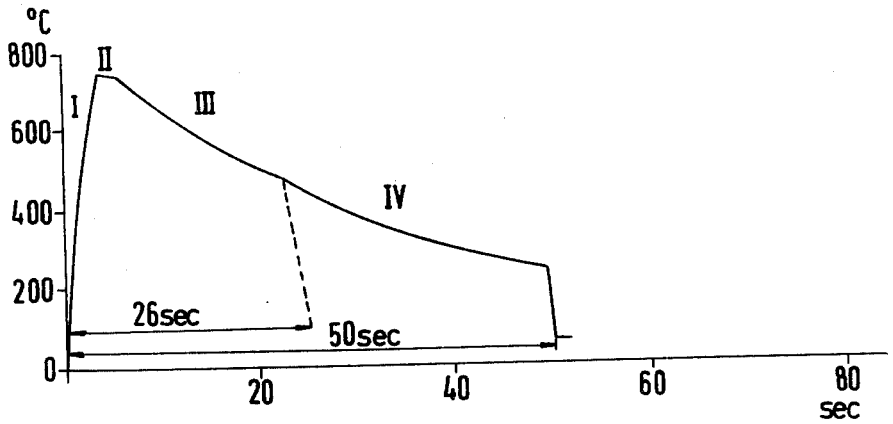

FIGS. 3*a* and *b* show two processes in accordance with the present invention in which the step (IV) of rapid cooling by a jet of atmospheric gas (solid line) is replaced by quenching in hot water kept at a temperature higher than 75° C. (broken line). FIG. 3*a* illustrates a so-called short cycle whose duration is still further reduced from 50s (FIG. 2) to 26s.

Figure 3B:
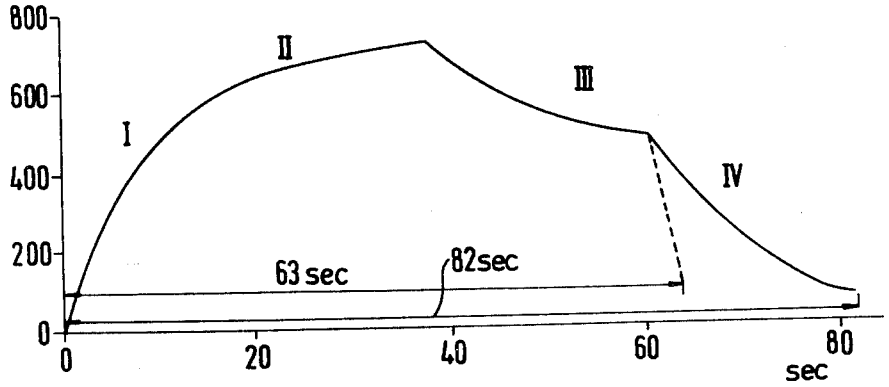

FIG. 3*b* illustrates a so-called long cycle whose duration is reduced from 82s (FIG. 1) to 63s.

In this way it is possible to achieve the same quality while still saving a substantial length of line (about 135 m of the path of the strip for a line producing 36 t/h). It is also possible to obtain hard qualities (high tempers) more easily than it is possible at present.

Mere suppression of cooling in the zone III makes it possible to obtain high hardness (temper higher than 4) starting from milder steel than is possible at present, with the advantage of substantially increasing the productivity of the tandem train of cold-rolling mills, especially if measures are taken in this case to increase the temperature in the holding step (760° to 850° C. instead of 700° C.).

Figure 4:
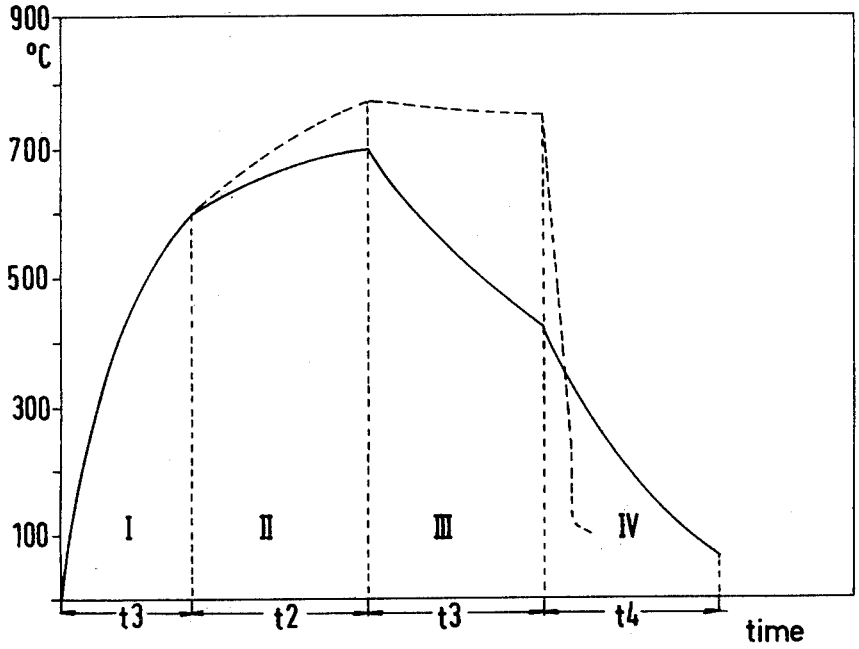

FIG. 4 illustrates (in broken line) a cycle obtained by eliminating the step III and by increasing the temperature in the holding step.

The above examples show that, by simple variation of the temperature of the strip upon entry into the aqueous bath kept at a temperature higher than 75° C., it is possible to obtain a wide hardness range. The actual qualities are obtained by letting controlled cooling take place normally in the zone III, so that the strip enters the bath at a temperature sufficiently low to avoid hardening. Qualities of increasingly higher hardness are obtained by decreasing the cooling in the zone III so that the strip in the aqueous bath has a higher temperature.

Figure 5:
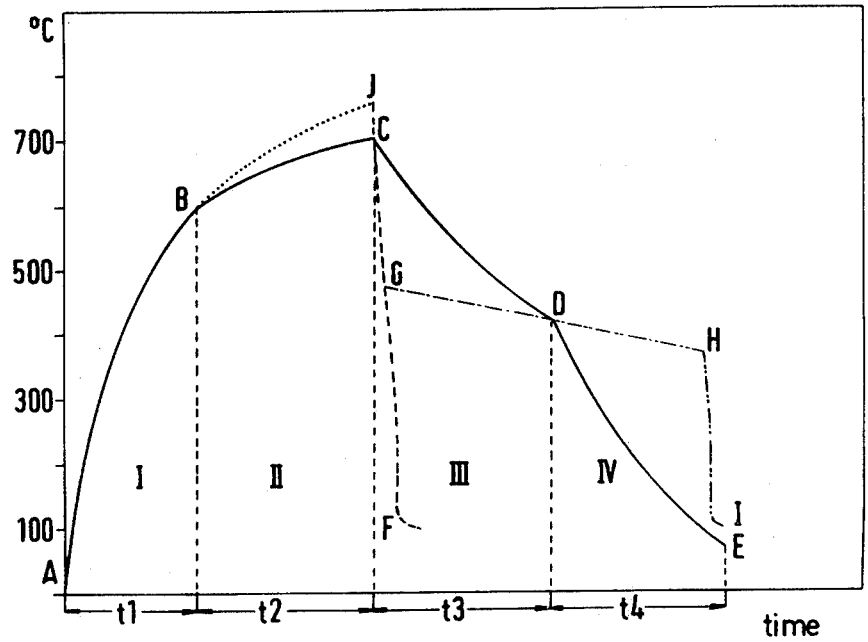

FIG. 5 shows another example of a process according to the present invention in comparison with a conventional long cycle (solid lines ABCDE). Quenching in a hot water bath is provided between the steps II (holding homogenization) and III (controlled cooling).

The curve ABCF comprising the broken line CF defines a process in accordance with the present invention in which the steps III of controlled cooling (line CD) and IV of rapid cooling (line DE) of the "long" cycle are replaced by quenching in hot water at a temperature higher than 75° C. (line CF), the point F indicating a temperature lower than 350° C. This process makes it possible to facilitate production of high hardness (tempers higher than 4) and is close to that of FIG. 4 for nearly the same time of holding.

On the other hand, the curve ABCGDE including the chain line GD constitutes a variant of the preceding process in the sense that quenching in hot water kept at a temperature higher than 75° C. (line CF is interrupted at a temperature lower than 550° C. for a time substantially equal to the time ($t_3$) normally occupied by the step III of controlled cooling of the conventional long cycle, after which the cycle includes a final rapid cooling step (line DE, for example). This process also permits the production range to be extended towards low hardnesses (tempers 1 to 4).

The holding time at the overaging temperature may be further increased according to the chain line DH, i.e. over the entire zone IV (time $t_4$), by also effecting the final cooling (line HI) in hot water kept at a temperature higher than 75° C., although the hardening due to holding for some twenty seconds (zone III) for example at 450° C. is already substantial.

The three above-described processes represented by the curves ABCGF,ABCGDE, and ABCGDHI can still be improved by increasing the temperature in the holding zone II, for example by following the dotted line BJ instead of the line BC.

The same improvements may also be applied to the so-called "short" cycle of FIG. 2.

EXAMPLE 1

Production of tin plate of low temper by continuous annealing.

| | Starting steels (wt %) | | | | | | |
|---|---|---|---|---|---|---|---|
| | C | Mn | Si | Al | P | $N_2$ | S |
| A | 0.040 | 0.260 | — | — | 0.008 | 0.0025 | 0.010 |
| B | 0.038 | 0.270 | 0.200 | 0.040 | 0.007 | 0.0023 | 0.010 |

Steel A is an ordinary rimming steel, while steel B is a killed steel which has been obtained by continuous casting. The steels were hot-rolled, with a temperature of 880° C. at the end of the rolling operation, the coiling temperature being 620° C. The thickness after hot rolling, was 1.9 mm. After pickling the steel was cold rolled to a thickness of 0.25 mm and subjected to the following annealing cycles.

Cycle 1

Conventional cycle as that of FIG. 1 with the following parameters:

heating for 16s to 640° C.;
holding for 22s at 640° to 705° C.;
controlled cooling for 22s to 425° C.;
rapid cooling for 22s to 75° C.

Cycle 2

This cycle is similar to the conventional cycle except that step IV is replaced by quenching in a hot water bath as in FIG. 3*b* (broken Line). In this case the temperature of the bath is 94° C.

The following cycles 3 to 7 correspond to the curve ABCGDE in FIG. 5.

Cycle 3

(a) heating for 16s to 640° C.;
(b) holding for 22s at 640° to 705° C.;
(c) quenching in an aqueous bath kept at 98° C., for variable durations;
(d) passing through a furnace at 300° C. for 22s
(e) rapid cooling for 22s to 75° C.

Cycle 4

Same as cycle 3 except that the temperature of the furnace in step (d) is 350° C.

Cycle 5

Same as cycle 3 except that the temperature of the furnace in (d) is 425° C.

Cycle 6

Same as cycle 3 except that the temperature of the furnace in step (d) is 525° C.

Cycle 7

Same as cycle 3 except that the temperature of the furnace in step (d) is 550° C.

Cycle 8

Same as cycle 5 except that step (e) is replaced by slow cooling for 20s to 300° C. and quenching for 2s in a second aqueous bath at a temperature of 87° C. (curve ABCGDHI in FIG. 5).

It should be noted that for cycles 3 to 8 the duration of step (d) is sufficient to bring the temperature of the strip to the temperature of the furnace at least at the outlet of the furnace.

Cycle 9 heating for 16s to 680° C.;
holding for 22s at 680° C. to 750° C.;
controlled cooling for 22s from 750° to 690° C.;
quenching for 1s in an aqueous bath at 96° C.;
passing through a furnace at 425° C. for 22s;
quenching for 3s in an aqueous bath at 80° C.

Results

The mechanical properties (hardness), after annealing, tin plating, and re-melting (flow brightening of the tin layer), are given in the following table.

| Cycle | duration of step (c) (seconds) | Steel A Hardness HR 30 T after annealing | Steel A Hardness HR 30 T after tin plating | Steel B Hardness HR 30 T after annealing | Steel B Hardness HR 30 T after tin plating |
|---|---|---|---|---|---|
| 1 | — | 58 | 62 | 59 | 62 |
| 2* | — | 57 | 62 | 58 | 62 |
| 3* | 1 | 58 | 61 | 57 | 62 |
| | 2 | 57 | 60 | 56 | 59 |
| | 3 | 59 | 62 | 60 | 63 |
| | 4 | 63 | 65 | 62 | 65 |
| | 5 | 64 | 66 | 65 | 67 |
| 4* | 1 | 54 | 58 | 53 | 57 |
| | 2 | 53 | 56 | 53 | 57 |
| | 3 | 53 | 56 | 52 | 55 |
| | 4 | 54 | 58 | 53 | 59 |
| | 5 | 56 | 60 | 55 | 59 |
| | 10 | 56 | 60 | 55 | 59 |
| 5* | 1 | 54 | 57 | 53 | 56 |
| | 2 | 53 | 55 | 51 | 54 |
| | 3 | 53 | 55 | 52 | 54 |
| | 4 | 54 | 57 | 53 | 55 |
| | 5 | 57 | 60 | 56 | 58 |
| 6* | 1 | 56 | 58 | 56 | 58 |
| 043137-7201709 | 2 | 54 | 57 | 53 | 56 |
| | 3 | 53 | 56 | 54 | 56 |
| | 4 | 53 | 56 | 54 | 56 |
| | 5 | 54 | 57 | 55 | 57 |
| 7* | 1 | 57 | 60 | 58 | 60 |
| | 2 | 58 | 61 | 57 | 60 |
| | 3 | 57 | 59 | 58 | 60 |
| | 4 | 56 | 59 | 57 | 61 |
| | 5 | 56 | 59 | 57 | 60 |
| 8* | 1 | 53 | 56 | 52 | 55 |
| | 2 | 52 | 55 | 51 | 53 |
| | 3 | 52 | 54 | 51 | 53 |
| | 4 | 53 | 56 | 53 | 55 |
| | 5 | 56 | 59 | 56 | 58 |
| 9* | — | 51 | 53 | 51 | 53 |

*In accordance with the invention.

It will be noted that replacement of the final cooling by quenching in a hot aqueous bath (Cycle 2) makes it possible to effectively obtain the same quality as the conventional cycle with a much reduced length of the line. On the other hand, the addition of quenching in hot water before the overaging step III results in a reduction of hardness in all the cases and especially when the overaging temperature is between 350° and 550° C. The duration of the quenching step may be advantageously adjusted so that the temperature of the strip at the end of the quenching operation is in a temperature range suitable for overaging, thereby saving energy.

Tests have shown that the duration of overaging has very little influence. Between cycle 5 and cycle 8, one gains only one points of hardness HR30T. Similarly, tests have shown that in the case of cycles 4 to 6, it is possible to reduce the duration of the step (d) to 2s without negatively affecting the properties.

Finally, as will be seen in Example 2, cycle 3 shows that when the quenching duration is sufficient and the overaging temperature is sufficiently low, it is possible to obtain high hardness (T5) starting from an extra-mild steel.

EXAMPLE 2

Production of high tempers by continuous annealing

The steel had in this case the following composition (wt%)

| C | Mn | Si | Al | $N_2$ | P |
|---|---|---|---|---|---|
| 0.08 | 0.500 | — | — | 0.0045 | 0.015 |

The temperature at the end of the hot rolling operation was 880° C. and the coiling temperature was 600° C., with a final hot-rolled thickness of 2.1 mm.

After pickling, the strip was cold-rolled to a thickness of 0.5 mm and was then subjected to the following annealing cycles.

Cycle 1

Heating for 32s to 640° C.;
holding for 44s at 640° to 705° C.;
controlled cooling for 44s to 425° C.;
rapid cooling for 44s to 75° C., Cycle 2

Heating for 32s to 680° C.;
holding for 44s at 680° to 705° C.;
quenching for 5.5s in an aqueous bath at 99° C.;
passing through a furnace at 250° C. for 44s;
final cooling for 44s to 75° C.

Cycle 3

Heating for 32s to 680° C.;
holding for 44s at 680° to 750° C.;
quenching for 5.5s in an aqueous bath at 99° C.;
passing through a furnace at 250° C. for 44s;
final cooling for 44s to 75° C.

Cycle 4

Heating for 32s to 680° C.;
heating from 680° to 800° C. for 44s;
quenching for 5.5s in an aqueous bath at 99° C.;
passing through a furnace at 250° C. for 44s;
final cooling for 44s to 75° C.;
Heating for 32s to 700° C.
Heating from 700° to 850° C. for 44s.

Cycle 5

Same as cycle 2 except that quenching in the aqueous bath has a duration of 12s.

Cycle 6

Same as cycle 4 except that the last furnace is at 350° C.

| Cycle | Results: Hardness H R 30 T annealed | Hardness H R 30 T tin plated |
|---|---|---|
| 1 | 59 | 63 |
| 2* | 61 | 65 |
| 3* | 63 | 67 |

-continued

| Cycle | Results: Hardness H R 30 T annealed | Hardness H R 30 T tin plated |
|---|---|---|
| 4* | 66 | 70 |
| 5* | 66 | 70 |
| 6* | 61 | 65 |

*In accordance with the invention.

The results clearly show that rapid cooling by quenching in a hot aqueous bath makes it possible to considerably increase hardness, provided that there is no holding at a temperature higher than 300° C. after quenching. Finally, hardening is greater the higher the heating temperature before quenching.

The heating and holding times given in the Examples 1 and 2 have been intentionally chosen equal to the actual durations experienced in conventional lines to show the ease with which the invention can be applied to the existing lines.

Obviously, the invention may be also applied to the so-called short lines or to any other lines in which these durations are different, for these parameters are shown to be without influence on the properties, obtained.

I claim:

1. A process for the continuous heat treatment of a cold-rolled steel strip, having a thickness of about from 0.05 to 1.0 mm for subsequent use in the production of tin plate of a class of hardness higher than $T_4$, comprising the sequential steps of heating said strip to a temperature within the range of about from 705° C. to 850° C., holding the strip at this temperature for more than one second, subjecting the resulting strip to a cooling operation comprising quenching the strip in an aqueous bath kept at a temperature higher than 75° C. for a time duration of less than 10 seconds, the strip emerging from the aqueous bath at a temperature of about from 75° C. to 300° C., holding the strip at a temperature of less than 300° C. for a time duration of at least one second and cooling the strip to ambient temperature.

2. The process as claimed in claim 1, which includes the further step of tin plating the steel strip finally obtained.

* * * * *